US009695717B2

(12) United States Patent
Yamamoto et al.

(10) Patent No.: US 9,695,717 B2
(45) Date of Patent: Jul. 4, 2017

(54) CONTROL DEVICE FOR INTERNAL COMBUSTION ENGINE

(71) Applicants: Shunsuke Yamamoto, Chiryu (JP); Toyokazu Nakashima, Mie-ken (JP)

(72) Inventors: Shunsuke Yamamoto, Chiryu (JP); Toyokazu Nakashima, Mie-ken (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 15 days.

(21) Appl. No.: 14/903,011

(22) PCT Filed: May 27, 2014

(86) PCT No.: PCT/JP2014/063995
§ 371 (c)(1),
(2) Date: Jan. 5, 2016

(87) PCT Pub. No.: WO2015/005004
PCT Pub. Date: Jan. 15, 2015

(65) Prior Publication Data

US 2016/0146070 A1 May 26, 2016

(30) Foreign Application Priority Data

Jul. 9, 2013 (JP) ..... 2013-143623

(51) Int. Cl.
*F01L 1/344* (2006.01)
*F02D 41/20* (2006.01)
(Continued)

(52) U.S. Cl.
CPC ..... *F01L 1/3442* (2013.01); *F02D 13/02* (2013.01); *F02D 41/20* (2013.01);
(Continued)

(58) Field of Classification Search
CPC .. F02D 13/02; F02D 13/0215; F02D 13/0234; F02D 13/0249; F02D 41/20;
(Continued)

(56) References Cited

U.S. PATENT DOCUMENTS 5,622,144 A * 4/1997 Nakamura ..... F01L 1/34406 123/90.15
7,278,385 B2 * 10/2007 Knecht ..... F01L 1/3442 123/90.15
(Continued)

FOREIGN PATENT DOCUMENTS

JP 2010-275970 A 12/2010

OTHER PUBLICATIONS

International Search Report Issued Sep. 2, 2014 in PCT/JP14/063995 Filed May 27, 2014.

*Primary Examiner* — John Kwon
*Assistant Examiner* — Johnny H Hoang
(74) *Attorney, Agent, or Firm* — Oblon, McClelland, Maier & Neustadt, L.L.P.

(57) ABSTRACT

A control device for an engine includes a variable valve timing mechanism. The control device performs learning a holding control amount of a hydraulic valve when actual valve timing is held at a fixed timing in each of spring and non-spring regions, and an updating. The updating includes updating the control amount for the non-spring region whenever the control amount for the spring region learned drops below the control amount for the non-spring region to satisfy a relationship with the control amount for the non-spring region being less than or equal to the control amount for the spring region, and/or updating the control amount for the spring region whenever the control amount for the non-spring region learned exceeds the control amount for the spring region to satisfy a relationship with the control
(Continued)

amount for the spring region being greater than or equal to the control amount for the non-spring region.

16 Claims, 5 Drawing Sheets

(51) Int. Cl.

| | |
|---|---|
| ***F02D 41/24*** | (2006.01) |
| *F02D 13/02* | (2006.01) |
| *F01L 1/053* | (2006.01) |
| *F02D 41/00* | (2006.01) |
| *F02D 41/14* | (2006.01) |

(52) U.S. Cl.
CPC .. *F02D 41/2451* (2013.01); *F01L 2001/0537* (2013.01); *F01L 2001/3443* (2013.01); *F01L 2001/34463* (2013.01); *F01L 2001/34483* (2013.01); *F01L 2250/02* (2013.01); *F01L 2250/04* (2013.01); *F01L 2800/00* (2013.01); *F02D 13/0215* (2013.01); *F02D 13/0234* (2013.01); *F02D 13/0249* (2013.01); *F02D 2041/001* (2013.01); *F02D 2041/1409* (2013.01); *F02D 2041/2027* (2013.01)

(58) Field of Classification Search
CPC ..... F02D 2041/011; F02D 2041/1409; F02D 2041/2027; F01L 1/3442; F01L 2001/0537; F01L 2001/34463; F01L 2001/34483; F01L 2001/3443; F01L 2250/02; F01L 2250/04; F01L 2800/00; Y02T 10/18
USPC ..... 123/90.11–90.17, 90.31, 90.55, 350; 701/102, 105
See application file for complete search history.

(56) References Cited

U.S. PATENT DOCUMENTS

| | | | | |
|---|---|---|---|---|
| 2003/0101952 | A1* | 6/2003 | Uehara | F01L 1/024 123/90.16 |
| 2012/0291722 | A1* | 11/2012 | Kanda | F02D 13/0238 123/41.02 |
| 2013/0025568 | A1* | 1/2013 | Yokoyama | F01L 1/3442 123/445 |
| 2013/0055980 | A1* | 3/2013 | Yokoyama | F01L 1/2405 123/90.17 |
| 2014/0216375 | A1* | 8/2014 | Miyazaki | B60K 6/48 123/90.15 |
| 2014/0230762 | A1* | 8/2014 | Nakashima | F01L 1/3442 123/90.12 |

* cited by examiner

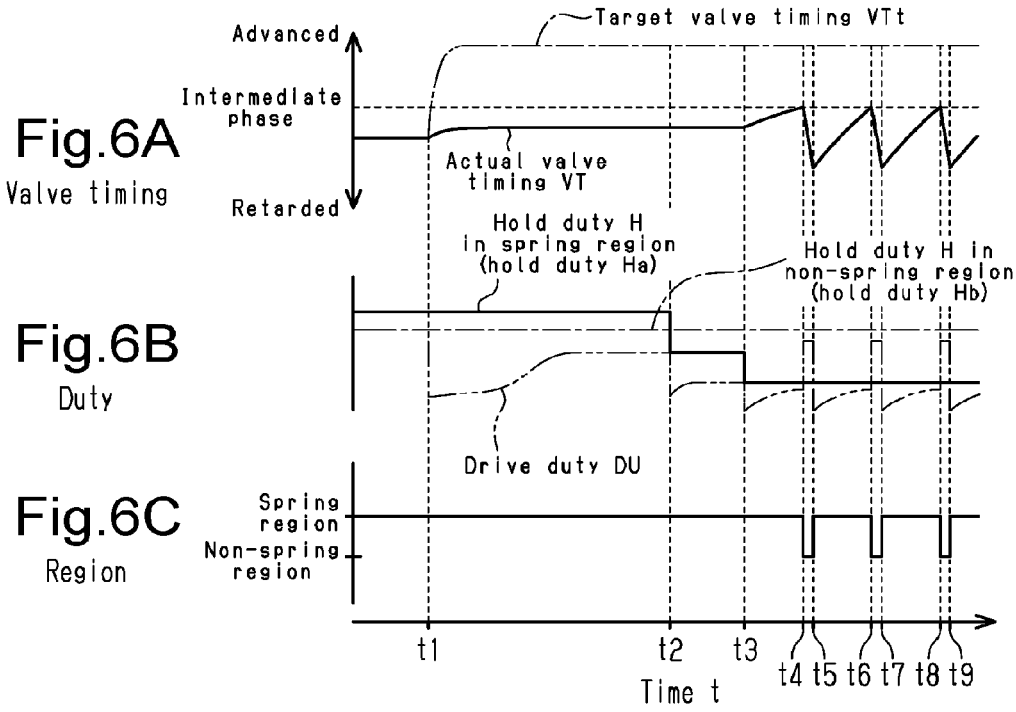
Fig.6A
Valve timing
Fig.6B
Duty
Fig.6C
Region
Advanced
Intermediate phase
Retarded
Target valve timing VTt
Actual valve timing VT
Hold duty H in spring region (hold duty Ha)
Hold duty H in non-spring region (hold duty Hb)
Drive duty DU
Spring region
Non-spring region
t1
t2
t3
t4 t5 t6 t7 t8 t9
Time t

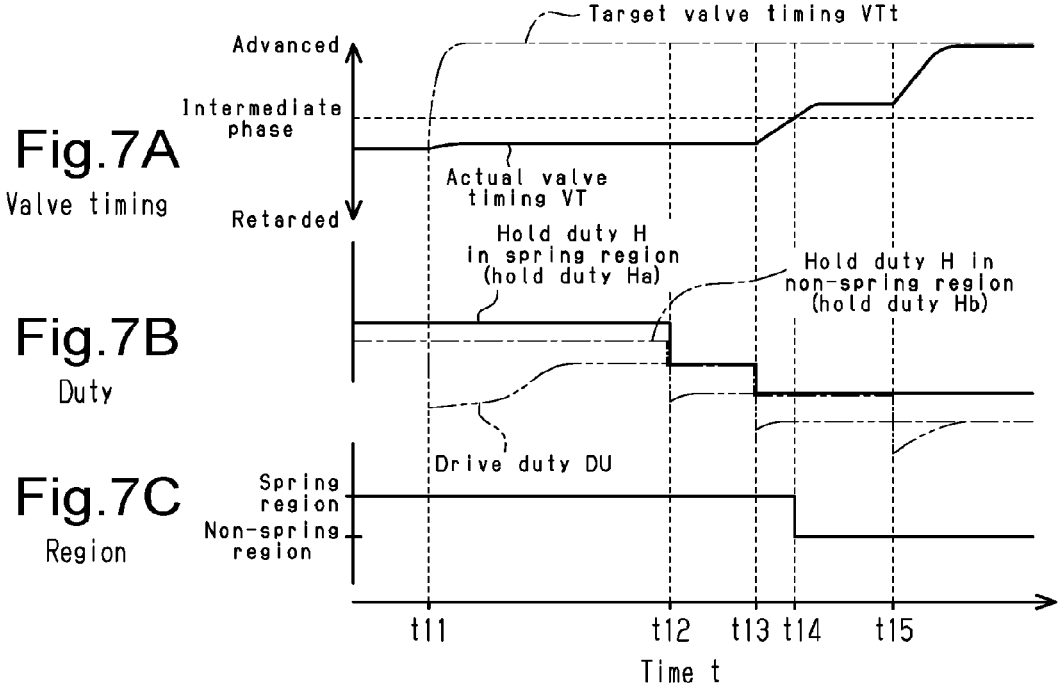
Fig.7A
Valve timing
Fig.7B
Duty
Fig.7C
Region
Advanced
Intermediate phase
Retarded
Target valve timing VTt
Actual valve timing VT
Hold duty H in spring region (hold duty Ha)
Hold duty H in non-spring region (hold duty Hb)
Drive duty DU
Spring region
Non-spring region
t11
t12
t13 t14
t15
Time t

CONTROL DEVICE FOR INTERNAL COMBUSTION ENGINE

TECHNICAL FIELD

The present invention relates to a control device for an internal combustion engine that includes a variable valve timing mechanism, which varies the valve timing of engine valves.

BACKGROUND ART

Patent document 1 describes an internal combustion engine that includes a variable valve timing mechanism. The variable valve timing mechanism includes a first rotary body, which rotates in cooperation with the rotation of a crankshaft, and a second rotary body, which rotates together with a camshaft. The variable valve timing mechanism uses hydraulic pressure, which is supplied from a hydraulic control valve to advancing chambers and retarding chambers, to change the rotation phase of the second rotary body relative to the first rotary body and vary the valve timing of engine valves. The control amount (duty) of the hydraulic control valve is set based on a feedback control amount, which is calculated based on the deviation of the actual valve timing from the target valve timing, and a holding control amount (hold duty), which is used to hold the actual valve timing at a constant timing.

The variable valve timing mechanism described in patent document 1 also includes a spring that urges the second rotary body to a position at which the rotation phase of the second rotary body relative to the first rotary body corresponds to a predetermined phase between the most retarded phase and the most advanced phase. Additionally, the variable valve timing mechanism may include, for example, a lock mechanism that fixes the relative rotation phase at a predetermined phase that is suitable for starting the engine. In this case, even if the relative rotation phase is not fixed by the lock mechanism when the engine stalls and stops, the urging force of the spring allows the relative rotation phase to be set in the predetermined phase, which can be fixed by the lock mechanism.

The above relative rotation phase includes a spring region, in which the second rotary body receives the urging force of the spring, and a non-spring region, in which the second rotary body does not receive the urging force of the spring. The control amount of the hydraulic control valve that is needed to hold the actual valve timing at a constant timing when the relative rotation phase is in the spring region differs from that when the relative rotation phase is in the non-spring region. In addition to the difference between the spring region and the non-spring region, the control amount of the hydraulic control valve that is needed to hold the actual valve timing at the constant timing also differs depending on the present operation state of the variable valve timing mechanism, such as the viscosity of the hydraulic oil. Thus, the control device of the internal combustion engine described in patent document 1 performs a learning process, in which the control device learns that a holding control amount is the control amount that holds the actual valve timing at the constant valve timing when the relative rotation phase of the first rotary body and the second rotary body is in the spring region and when the relative rotation phase is in the non-spring region.

PRIOR ART DOCUMENT

Patent Document

Patent Document 1: Japanese Laid-Open Patent Publication No. 2010-275970

SUMMARY OF THE INVENTION

Problems that are to be Solved by the Invention

However, depending on the engine operation state, the holding control amount may be continuously learned in one of the spring region and the non-spring region during which the holding control amount is not learned in the other one of the spring region and the non-spring region. In this case, in the region where the learning is performed, the holding control amount is sequentially changed to a value corresponding to the present operation state of the variable valve timing mechanism, such as the viscosity of the hydraulic oil. However, in the region where the learning is not performed, the holding control amount is not learned. This may invert the magnitude relationship of the holding control amount of the spring region and holding control amount of the non-spring region from the original relationship. When the magnitude relationship in the holding control amount of the spring region and the non-spring region is inverted, hunting of the actual valve timing occurs when the relative rotation phase is shifted in accordance with a change in the target valve timing from the region where the holding control amount has been continuously learned to the region where the holding control amount has not been learned. Such hunting occurs, for example, as follows. When the actual valve timing is advanced toward the target valve timing and the relative rotation phase is shifted across regions, the holding control amount is changed such that the magnitude relationship is inverted from the original relationship as described above. This retards the actual valve timing. Consequently, the actual valve timing is advanced again toward the target valve timing. Such repetitive retardation and advancement of the actual valve timing results in hunting. Due to the hunting, the actual valve timing may fail to follow changes in the target valve timing.

It is an object of the present invention to provide a control device for an internal combustion engine that limits hunting of the actual valve timing even when the holding control amount is continuously learned in either one of the spring region and the non-spring region and the target valve timing is shifted across regions.

Means for Solving the Problem

To achieve the above object, a control device for an internal combustion engine includes a variable valve timing mechanism. The variable valve timing mechanism includes a first rotation body, which rotates in cooperation with rotation of a crankshaft, and a second rotation body, which rotates together with a camshaft, and varies a valve timing of an engine valve by changing a relative rotation phase of the second rotation body and the first rotation body using hydraulic pressure, which is supplied from a hydraulic control valve to an advancing chamber and a retarding chamber. The variable valve timing mechanism includes a spring that urges the second rotation body so that the relative rotation phase is located at a position corresponding to a predetermined phase between a most advanced phase and a most retarded phase. In the control device for the internal combustion engine, when a region of the relative rotation phase where the second rotation body receives urging force from the spring defines a spring region and a region of the relative rotation phase where the second rotation body does not receive urging force from the spring defines a non-spring region, a control amount of the hydraulic control valve needed to hold an actual valve timing at a constant timing in the spring region is greater than a control amount of the hydraulic control valve needed to hold the actual valve timing at a constant timing in the non-spring region. The control device for the internal combustion engine is configured to perform a learning process that learns a holding control amount of the hydraulic control valve when the actual valve timing is held at a constant timing in each of the spring region and the non-spring region. The control device for the internal combustion engine is also configured to perform at least one of an update process that updates the holding control amount of the non-spring region whenever the holding control amount of the spring region, which is learned in the learning process, becomes less than the holding control amount of the non-spring region to satisfy a relationship in which the holding control amount of the non-spring region is less than or equal to the holding control amount of the spring region, and an update process that updates the holding control amount of the spring region whenever the holding control amount of the non-spring region, which is learned in the learning process, becomes greater than the holding control amount of the spring region to satisfy a relationship in which the holding control amount of the spring region is greater than or equal to the holding control amount of the non-spring region.

To achieve the above object, a control device for an internal combustion engine includes a variable valve timing mechanism. The variable valve timing mechanism includes a first rotation body, which rotates in cooperation with rotation of a crankshaft, and a second rotation body, which rotates together with a camshaft, and varies a valve timing of an engine valve by changing a relative rotation phase of the second rotation body and the first rotation body using hydraulic pressure, which is supplied from a hydraulic control valve to an advancing chamber and a retarding chamber. The variable valve timing mechanism includes a spring that urges the second rotation body so that the relative rotation phase is located at a position corresponding to a predetermined phase between a most advanced phase and a most retarded phase. In the control device for the internal combustion engine, when a region of the relative rotation phase where the second rotation body receives urging force from the spring defines a spring region and a region of the relative rotation phase where the second rotation body does not receive urging force from the spring defines a non-spring region, a control amount of the hydraulic control valve needed to hold an actual valve timing at a constant timing in the spring region is greater than a control amount of the hydraulic control valve needed to hold the actual valve timing at a constant timing in the non-spring region. The control device for the internal combustion engine is configured to perform a learning process that learns a holding control amount of the hydraulic control valve when the actual valve timing is held at a constant timing in each of the spring region and the non-spring region. The control device for the internal combustion engine is also configured to perform at least one of an update process that updates the holding control amount of the non-spring region when the relative rotation phase is shifted from the spring region to the non-spring region so that the holding control amount of the non-spring region satisfies a relationship in which the holding control amount of the non-spring region is less than or equal to the holding control amount that was last learned in the spring region, and an update process that updates the holding control amount of the spring region when the relative rotation phase is shifted from the non-spring region to the spring region so that the holding control amount of the spring region satisfies a relationship in which the holding control amount of the spring region is greater than or equal to the holding control amount that was last learned in the non-spring region.

To achieve the above object, a control device for an internal combustion engine includes a variable valve timing mechanism. The variable valve timing mechanism includes a first rotation body, which rotates in cooperation with rotation of a crankshaft, and a second rotation body, which rotates together with a camshaft, and varies a valve timing of an engine valve by changing a relative rotation phase of the second rotation body and the first rotation body using hydraulic pressure, which is supplied from a hydraulic control valve to an advancing chamber and a retarding chamber. The variable valve timing mechanism includes a spring that urges the second rotation body so that the relative rotation phase is located at a position corresponding to a predetermined phase between a most advanced phase and a most retarded phase. In the control device for the internal combustion engine, when a region of the relative rotation phase where the second rotation body receives urging force from the spring defines a spring region and a region of the relative rotation phase where the second rotation body does not receive urging force from the spring defines a non-spring region, a control amount of the hydraulic control valve needed to hold an actual valve timing at a constant timing in the spring region is greater than a control amount of the hydraulic control valve needed to hold the actual valve timing at a constant timing in the non-spring region. The control device for the internal combustion engine is configured to perform a learning process that learns a holding control amount of the hydraulic control valve when the actual valve timing is held at a constant timing in each of the spring region and the non-spring region. The control device for the internal combustion engine is also configured to perform at least one of a restriction process that restricts a lower limit value of the holding control amount of the spring region when the relative rotation phase is in the spring region to the holding control amount that was last learned in the non-spring region, and a restriction process that restricts an upper limit value of the holding control amount of the holding control amount of the non-spring region when the relative rotation phase is in the non-spring region to the holding control amount that was last learned in the spring region.

To achieve the above object, a control device for an internal combustion engine includes a variable valve timing mechanism. The variable valve timing mechanism includes a first rotation body, which rotates in cooperation with rotation of a crankshaft, and a second rotation body, which rotates together with a camshaft, and varies a valve timing of an engine valve by changing a relative rotation phase of the second rotation body and the first rotation body using hydraulic pressure, which is supplied from a hydraulic control valve to an advancing chamber and a retarding chamber. The variable valve timing mechanism includes a spring that urges the second rotation body so that the relative rotation phase is located at a position corresponding to a predetermined phase between a most advanced phase and a most retarded phase. In the control device for the internal combustion engine, when a region of the relative rotation phase where the second rotation body receives urging force from the spring defines a spring region and a region of the relative rotation phase where the second rotation body does not receive urging force from the spring defines a non-spring region, a control amount of the hydraulic control valve needed to hold an actual valve timing at a constant timing in the non-spring region is greater than a control amount of the hydraulic control valve needed to hold the actual valve timing at a constant timing in the spring region. The control device for the internal combustion engine is configured to perform a learning process that learns a holding control amount of the hydraulic control valve when the actual valve timing is held at a constant timing in each of the spring region and the non-spring region. The control device for the internal combustion engine is also configured to perform at least one of an update process that updates the holding control amount of the non-spring region whenever the holding control amount of the spring region, which is learned in the learning process, becomes greater than the holding control amount of the non-spring region to satisfy a relationship in which the holding control amount of the non-spring region is greater than or equal to the holding control amount of the spring region, and an update process that updates the holding control amount of the spring region whenever the holding control amount of the non-spring region, which is learned in the learning process, becomes less than the holding control amount of the spring region to satisfy a relationship in which the holding control amount of the spring region is less than or equal to the holding control amount of the non-spring region.

To achieve the above object, a control device for an internal combustion engine includes a variable valve timing mechanism. The variable valve timing mechanism includes a first rotation body, which rotates in cooperation with rotation of a crankshaft, and a second rotation body, which rotates together with a camshaft, and varies a valve timing of an engine valve by changing a relative rotation phase of the second rotation body and the first rotation body using hydraulic pressure, which is supplied from a hydraulic control valve to an advancing chamber and a retarding chamber. The variable valve timing mechanism includes a spring that urges the second rotation body so that the relative rotation phase is located at a position corresponding to a predetermined phase between a most advanced phase and a most retarded phase. In the control device for the internal combustion engine, when a region of the relative rotation phase where the second rotation body receives urging force from the spring defines a spring region and a region of the relative rotation phase where the second rotation body does not receive urging force from the spring defines a non-spring region, a control amount of the hydraulic control valve needed to hold an actual valve timing at a constant timing in the non-spring region is greater than a control amount of the hydraulic control valve needed to hold the actual valve timing at a constant timing in the spring region. The control device for the internal combustion engine is configured to perform a learning process that learns a holding control amount of the hydraulic control valve when the actual valve timing is held at a constant timing in each of the spring region and the non-spring region. The control device for the internal combustion engine is also configured to perform at least one of an update process that updates the holding control amount of the non-spring region when the relative rotation phase is shifted from the spring region to the non-spring region so that the holding control amount of the non-spring region satisfies a relationship in which the holding control amount of the non-spring region is greater than or equal to the holding control amount that was last learned in the spring region, and an update process that updates the holding control amount of the spring region when the relative rotation phase is shifted from the non-spring region to the spring region so that the holding control amount of the spring region satisfies a relationship in which the holding control amount of the spring region is less than or equal to the holding control amount that was last learned in the non-spring region.

To achieve the above object, a control device for an internal combustion engine includes a variable valve timing mechanism. The variable valve timing mechanism includes a first rotation body, which rotates in cooperation with rotation of a crankshaft, and a second rotation body, which rotates together with a camshaft, and varies a valve timing of an engine valve by changing a relative rotation phase of the second rotation body and the first rotation body using hydraulic pressure, which is supplied from a hydraulic control valve to an advancing chamber and a retarding chamber. The variable valve timing mechanism includes a spring that urges the second rotation body so that the relative rotation phase is located at a position corresponding to a predetermined phase between a most advanced phase and a most retarded phase. In the control device for the internal combustion engine, when a region of the relative rotation phase where the second rotation body receives urging force from the spring defines a spring region and a region of the relative rotation phase where the second rotation body does not receive urging force from the spring defines a non-spring region, a control amount of the hydraulic control valve needed to hold an actual valve timing at a constant timing in the non-spring region is greater than a control amount of the hydraulic control valve needed to hold the actual valve timing at a constant timing in the spring region. The control device for the internal combustion engine is configured to perform a learning process that learns a holding control amount of the hydraulic control valve when the actual valve timing is held at a constant timing in each of the spring region and the non-spring region. The control device for the internal combustion engine is also configured to perform at least one of a restriction process that restricts a lower limit value of the holding control amount of the non-spring region when the relative rotation phase is in the non-spring region to the holding control amount that was last learned in the spring region, and a restriction process that restricts an upper limit value of the holding control amount of the spring region when the relative rotation phase is in the spring region to the holding control amount that was last learned in the non-spring region.

BRIEF DESCRIPTION OF THE DRAWINGS

FIG. 6 is a timing chart showing changes in the valve timing, the duty, and the region of the valve timing when an update process is not performed.

FIG. 7 is a timing chart showing changes in the valve timing, the duty, and the region of the valve timing when the update process is performed.

EMBODIMENTS OF THE INVENTION

One embodiment of a control device for an internal combustion engine will now be described with reference to FIGS. 1 to 7.

Figure 1:
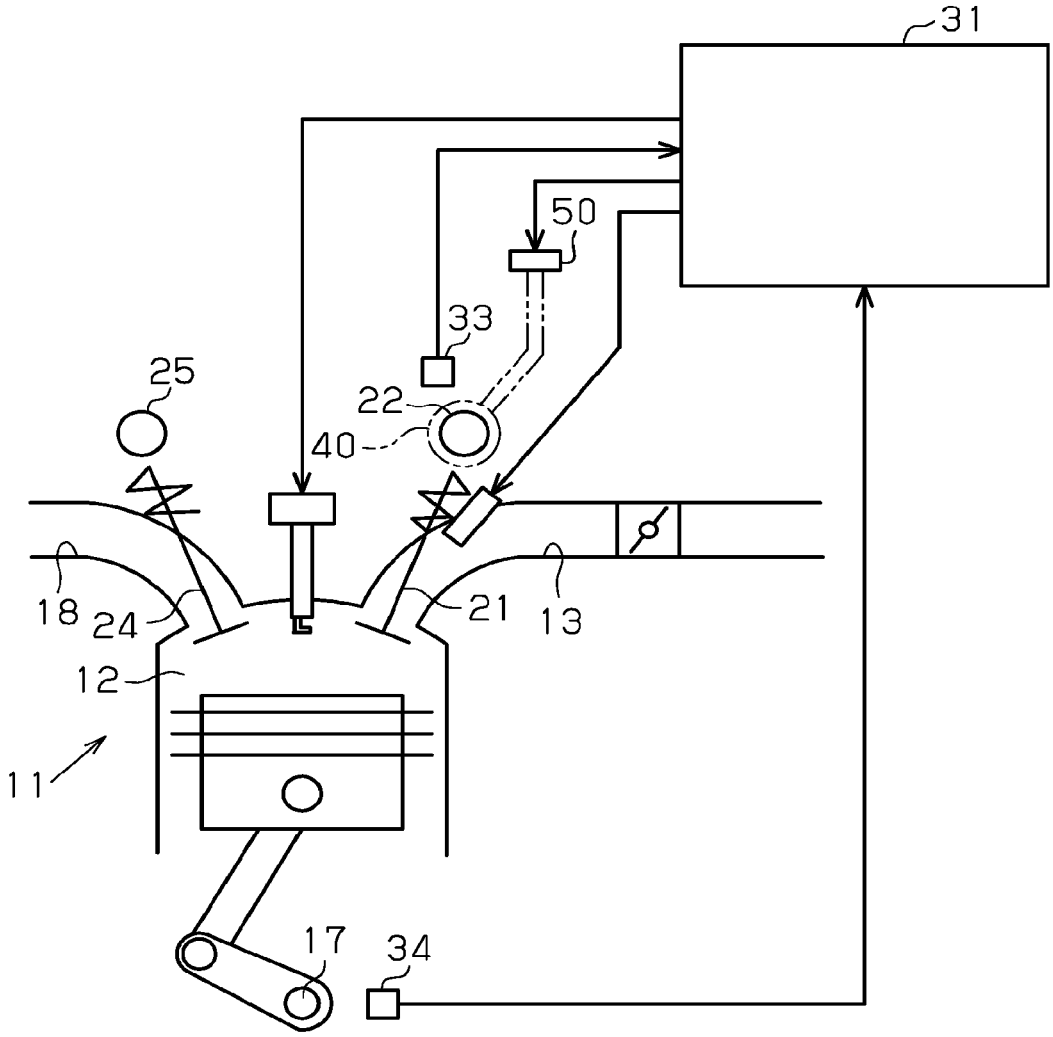
FIG. 1 is a schematic diagram showing the peripheral structure of an internal combustion engine and a control device.

As shown in FIG. 1, an internal combustion engine 11 includes a combustion chamber 12, which is selectively communicated with and disconnected from an intake passage 13 when the intake valve 21 opens and closes. The intake valve 21 opens and closes in accordance with the rotation of an intake camshaft 22, which is driven and rotated by a crankshaft 17. Additionally, the combustion chamber 12 of the internal combustion engine 11 is selectively communicated with and disconnected from an exhaust passage 18 when an exhaust valve 24 opens and closes. The exhaust valve 24 opens and closes in accordance with the rotation of an exhaust camshaft 25, which receives the rotation transmitted from the crankshaft 17.

The internal combustion engine 11 includes a variable valve timing mechanism 40, which is capable of varying the opening-closing timing (valve timing) of the intake valve 21. The variable valve timing mechanism 40 changes the relative rotation phase of the intake camshaft 22 and the crankshaft 17 using hydraulic oil, which is supplied from and discharged to an oil control valve 50, which functions as a hydraulic control valve, when the oil control valve 50 is driven.

The variable valve timing mechanism 40 and a hydraulic circuit for operating the variable valve timing mechanism 40 will now be described in detail.

Figure 2:
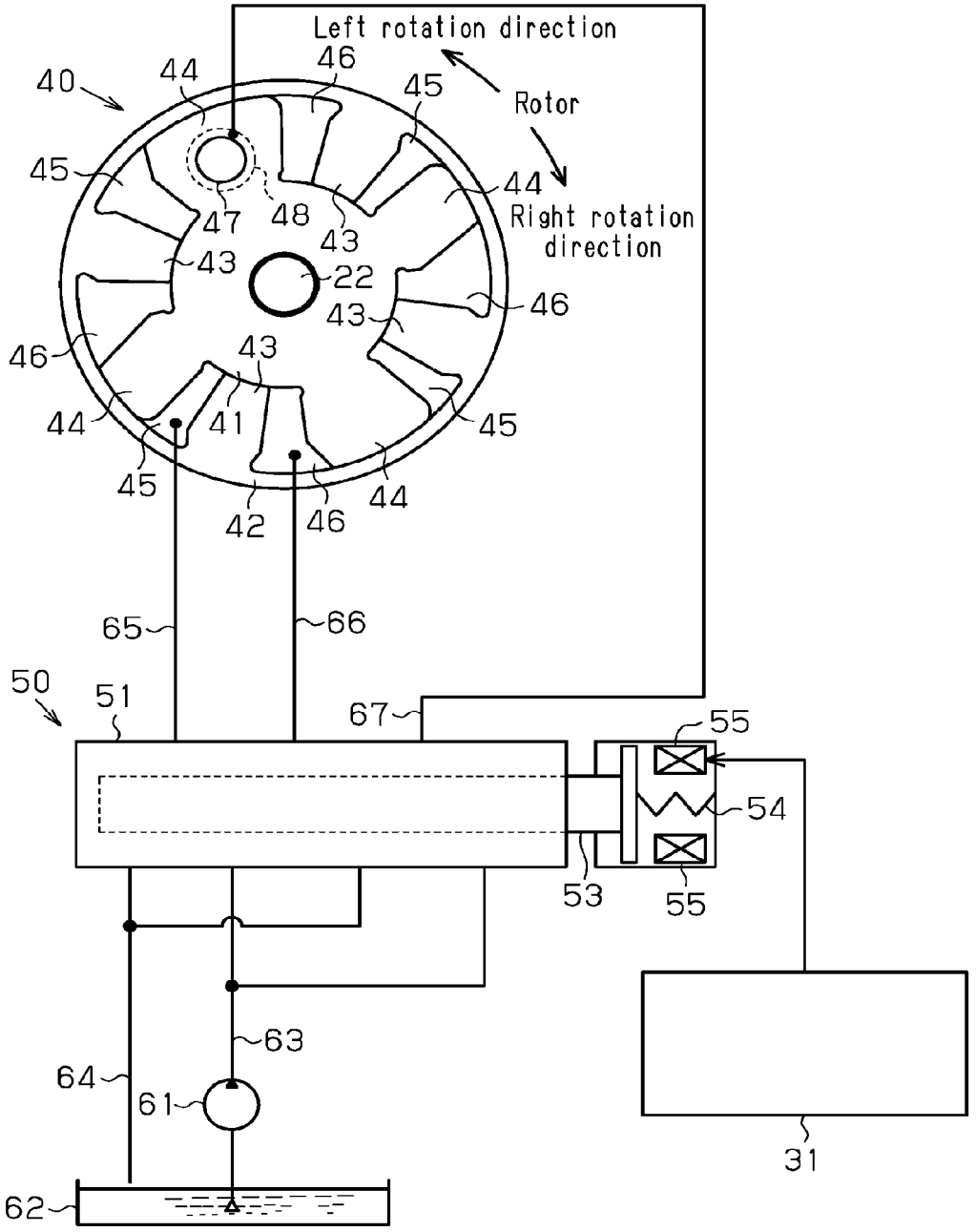
FIG. 2 is a block diagram showing a variable valve timing mechanism and a hydraulic circuit for driving the mechanism.

As shown in FIG. 2, the variable valve timing mechanism 40 includes a rotor 41 (second rotation body), which is fixed to the intake camshaft 22 in an integrally rotatable manner. The variable valve timing mechanism 40 also includes a housing 42 (first rotation body), which is arranged coaxially with the intake camshaft 22 around the rotor 41 and rotates in cooperation with rotation of the crankshaft 17. A plurality of projections 43 project from an inner surface of the housing 42 toward the axis of the intake camshaft 22 and are arranged at circumferentially predetermined intervals. A plurality of vanes 44 project radially outward from an outer surface of the rotor 41. The vanes 44 are each located between adjacent ones of the projections 43 and divide each portion between the adjacent projections 43 into an advancing chamber 45 and a retarding chamber 46. Switching of the supply and discharge of the hydraulic oil to and from the advancing chambers 45 and the retarding chambers 46 changes the rotation phase of the intake camshaft 22 relative to the crankshaft 17, that is, the rotation phase of the rotor 41 relative to the housing 42 (hereafter, simply referred to as the relative rotation phase).

More specifically, when the hydraulic oil is supplied to the advancing chambers 45 and discharged from the retarding chambers 46, the rotor 41 is rotated in the right direction in the drawing (clockwise direction) relative to the housing 42. This advances the relative rotation phase and the valve timing of the intake valve 21. Also, when the hydraulic oil is supplied to the retarding chambers 46 and discharged from the advancing chambers 45, the rotor 41 is rotated in the left direction in the drawing (counterclockwise direction) relative to the housing 42. This retards the relative rotation phase and the valve timing of the intake valve 21. In this manner, the variable valve timing mechanism 40 is driven to vary the valve timing of the intake valve 21.

Additionally, the variable valve timing mechanism 40 includes a lock mechanism 47, which is capable of switching between a lock state, in which the relative rotation phase is locked, and an unlocked state, in which the relative rotation phase is unlocked. The lock mechanism 47 includes an accommodation hole formed in a vane 44 of the rotor 41, a lock pin accommodated in the accommodation hole in an extendable and retractable manner, and a lock hole formed in the housing 42. The lock pin is constantly urged by a spring in a direction in which the lock pin is inserted into the lock hole and also urged by oil pressure of a release chamber 48 in a direction in which the lock pin is removed from the lock hole.

When switching the supply and discharge of the hydraulic oil to and from the release chamber 48, the lock mechanism 47 is switched between the lock state and the unlocked state. More specifically, when the hydraulic oil is discharged from the release chamber 48 of the lock mechanism 47 to decrease the oil pressure of the release chamber 48, the lock pin is forced out of the accommodation hole and inserted into the lock hole by the urging force of the spring. As a result, the lock mechanism 47 is set in the lock state. When the hydraulic oil is supplied to the release chamber 48 of the lock mechanism 47 to increase the oil pressure of the release chamber 48, the lock pin is removed from the lock hole and returned to the accommodation hole. As a result, the lock mechanism 47 is set in the unlocked state. Here, when the lock mechanism 47 is in the lock state, the relative rotation phase is restricted to an intermediate phase between the most advanced phase and the most retarded phase. When stopping the engine, the lock mechanism 47 is set in the lock state. Thus, when the engine is stopped, the relative rotation phase is locked in the intermediate phase. This increases the actual compression ratio during startup and improves the starting performance of the internal combustion engine 11.

The hydraulic oil is supplied to and discharged from the variable valve timing mechanism 40 through a hydraulic circuit, which connects the variable valve timing mechanism 40 and an oil pump 61. The hydraulic circuit includes a plurality of oil channels. The oil control valve 50 (hereafter, referred to as OCV 50), which is located in intermediate portions of the oil channels, changes the mode of the hydraulic oil supplied to and discharged from the variable valve timing mechanism 40 through the oil channels. The OCV 50 is connected to the oil pump 61 by a supply oil channel 63 and also connected to an oil pan 62 by a discharge oil channel 64. The oil pan 62 stores the hydraulic oil, which is pumped by the oil pump 61. Additionally, the OCV 50 is connected to the advancing chambers 45 of the variable valve timing mechanism 40 by an advance oil channel 65 and also connected to the retarding chambers 46 of the variable valve timing mechanism 40 by a retardation oil channel 66. Further, the OCV 50 is connected to the release chamber 48 of the lock mechanism 47 by a release oil channel 67.

The OCV 50 includes a sleeve 51, a spool 53, a spring 54, and an electromagnetic solenoid 55. The spool 53 is located in the sleeve 51 and movable in the axial direction. The spring 54 applies elastic force to the spool 53 in one of the movement directions. The electromagnetic solenoid 55 applies electromagnetic force to the spool 53 so that the spool 53 moves in the other direction of the movement directions. Each of the sleeve 51 and the spool 53 of the OCV 50 includes a plurality of ports, which are respectively communicated with the supply oil channel 63, the discharge oil channel 64, the advance oil channel 65, the retardation oil channel 66, and the release oil channel 67. When the duration of applying voltage to the electromagnetic solenoid 55 is changed in accordance with a drive duty, which functions as the control amount, the position of the spool 53 is adjusted in the OCV 50. The drive duty is changed within a predetermined range, for example, "0% to 100%." The electromagnetic force of the electromagnetic solenoid 55 decreases as the drive duty becomes smaller in the range. The electromagnetic force of the electromagnetic solenoid 55 increases as the drive duty becomes larger.

When the drive duty is decreased to decrease the electromagnetic force of the electromagnetic solenoid 55, the urging force of the spring 54 becomes larger than the electromagnetic force. The urging force of the spring 54 moves the spool 53 in a first direction (left side in the drawing). When the drive duty is increased to increase the electromagnetic force of the electromagnetic solenoid 55, the electromagnetic force becomes larger than the urging force of the spring 54. The electromagnetic force of the electromagnetic solenoid 55 moves the spool 53 in a second direction (right side in the drawing), which is opposite to the first direction. Thus, in the OCV 50, when one of a plurality of operation modes is selected through the position adjustments of the spool 53, the above ports are switched between a communication state and a disconnection state in accordance with the selected operation mode.

The operation modes of the OCV 50 are, for example, a lock mode, an advance mode, and a retardation mode.

The lock mode stops both the supply and discharge of the hydraulic oil to and from the advancing chambers 45 and the retarding chambers 46 and discharges the hydraulic oil from the release chamber 48. The lock mode allows the lock mechanism 47 to fix the relative rotation phase.

The advance mode supplies the hydraulic oil to the advancing chambers 45 and the release chamber 48 and discharges the hydraulic oil from the retarding chambers 46. In the advance mode, while the oil pressure of the advancing chambers 45 increases, the oil pressure of the retarding chambers 46 decreases. Thus, the rotation force acts on the rotor 41 so that the rotor 41 rotates relative to the housing 42 in the right direction of FIG. 2. Additionally, due to the increased oil pressure of the release chamber 48, the lock mechanism 47 releases the fixing of the relative rotation phase. The advance mode is selected when advancing the valve timing or holding the present valve timing.

The retardation mode supplies the hydraulic oil to the retarding chambers 46 and the release chamber 48 and discharges the hydraulic oil from the advancing chambers 45. In the retardation mode, while the oil pressure of the retarding chambers 46 increases, the oil pressure of the advancing chambers 45 decreases. Thus, the rotation force acts on the rotor 41 so that the rotor 41 rotates relative to the housing 42 in the left direction of FIG. 2. Additionally, due to the increased oil pressure of the release chamber 48, the lock mechanism 47 releases the fixing of the relative rotation phase. The retardation mode is selected when retarding the valve timing or holding the present valve timing.

The distance between the spool 53 and the electromagnetic solenoid 55 of the OCV55 is sequentially decreased in the lock mode, the advance mode, and the retardation mode. Accordingly, the amount of the electromagnetic force (drive duty) of the electromagnetic solenoid 55 for the operation modes of the OCV 50 is sequentially increased in the lock mode, the advance mode, and the retardation mode.

Additionally, as the spool 53 of the OCV 50 is located toward a first side (left side in the drawing), the supply amount of the hydraulic oil to the advancing chambers 45 increases, and the discharge amount of the hydraulic oil from the retarding chambers 46 increases. Thus, in the advance mode, as the value of the drive duty becomes smaller, the speed increases when advancing the actual valve timing (actual valve timing VT) of the intake valve 21. In contrast, in the retardation mode, as the spool 53 of the OCV 50 is located toward a second side (right side in the drawing), the supply amount of the hydraulic oil to the retarding chambers 46 increases, and the discharge amount of the hydraulic oil from the advancing chambers 45 increases. Thus, in the retardation mode, as the value of the drive duty becomes larger, the speed increases when retarding the actual valve timing VT.

Figure 3:
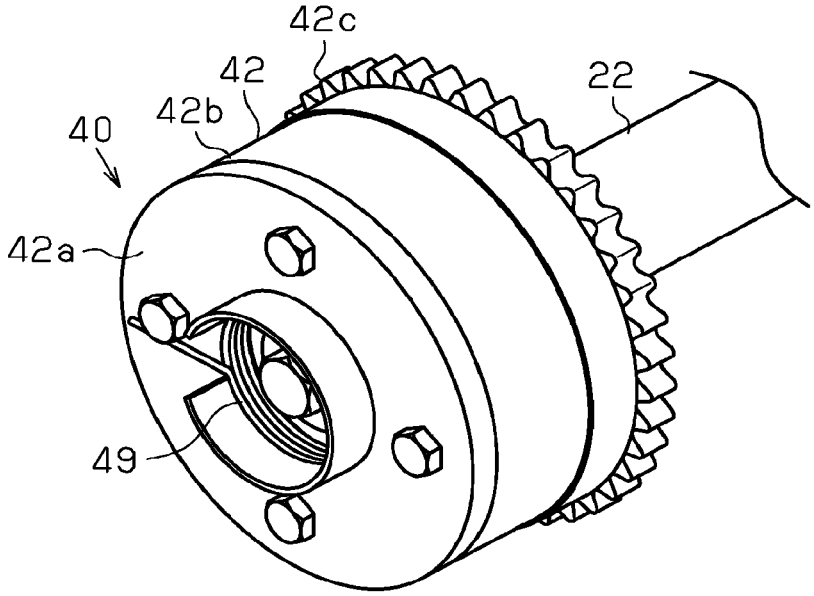
FIG. 3 is a perspective view showing the variable valve timing mechanism.
Figure 4:
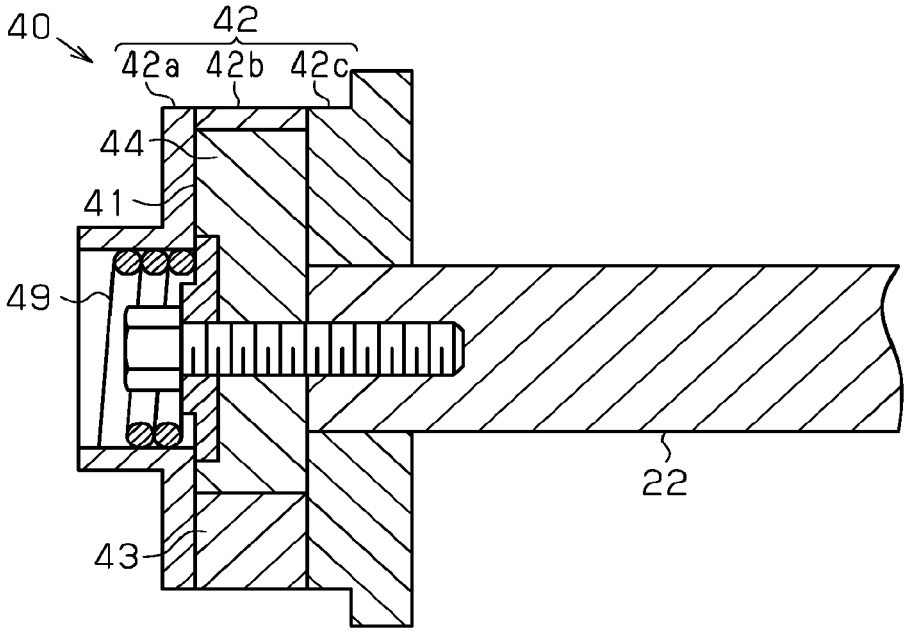
FIG. 4 is a cross-sectional view showing the variable valve timing mechanism.

As shown in FIGS. 3 and 4, the housing 42 of the variable valve timing mechanism 40 includes a body 42*b*, which includes the projections 43 and is covered by a cover 42*a*, and a sprocket 42*c*, to which the cover 42*a* and the body 42*b* are fixed. The sprocket 42*c* is coupled to the crankshaft 17 by a timing chain. Thus, the cover 42*a* and the body 42*b* of the housing 42 rotate integrally with the sprocket 42*c*. Additionally, the cover 42*a* of the housing 42 accommodates a spring 49 that urges the rotor 41 to rotate toward the advance side so that the relative rotation phase is in a position corresponding to the intermediate phase. Even when the engine stops due to engine stalling and the lock mechanism 47 fails to fix the relative rotation phase, the urging force of the spring 49 sets the relative rotation phase in the intermediate phase, which can be fixed by the lock mechanism 47.

When the spring 49 is arranged, the relative rotation phase is separated into a region where the rotor 41 receives the urging force from the spring 49, or a spring region located from the most retarded phase to the intermediate phase, and another region where the rotor 41 does not receive the urging force from the spring 49, or a non-spring region located from the intermediate phase to the most advanced phase. That is, the spring region is defined by the region of the relative rotation phase where the rotor 41 receives the urging force from the spring 49, and the non-spring region is defined by the region of the relative rotation phase where the rotor 41 does not receive the urging force from the spring 49. Hereafter, the phrase "the actual valve timing VT is in the spring region" means that the relative rotation phase is in the spring region, and the phrase "the actual valve timing VT is in the non-spring region" means that the relative rotation phase is in the non-spring region.

When the actual valve timing VT of the intake valve 21 is in the spring region, due to the urging force of the spring 49, the rotation force acts on the rotor 41 to advance the rotor 41. Thus, when the actual valve timing VT is in the spring region, the retardation mode is selected to increase the oil pressure of the retarding chambers 46 and decrease the oil pressure of the advancing chambers 45. This holds the actual valve timing VT of the intake valve 21 at the constant timing. When the actual valve timing VT is in the non-spring region, the rotation force due to the urging force of the spring 49 does not act on the rotor 41. However, rotation force acts to retard the rotor 41 due to friction caused by elastic force of a valve spring. Thus, when the actual valve timing VT is in the non-spring region, the advance mode is selected to increase the oil pressure of the advancing chambers 45 and decrease the oil pressure of the retarding chambers 46. This holds the actual valve timing VT of the intake valve 21 at the constant timing.

As described above, the value of the drive duty is greater when the drive mode of the OCV 50 is in the retardation mode than when the drive mode of the OCV 50 is in the advance mode. Accordingly, the drive duty of the OCV 50 that is needed to hold the actual valve timing of the intake valve 21 at the constant timing in the spring region is greater than in the non-spring region.

A control device 31 performs valve timing control, in which the OCV 50 is adjusted, together with various controls related to operation of the internal combustion engine 11. In the valve timing control, the actual valve timing VT is detected based on detection signals from a cam position sensor 33 and a crank position sensor 34, and a target valve timing VTt is set in accordance with the engine operation state. The control device 31 varies the actual valve timing VT so that the actual valve timing VT becomes equal to the target valve timing VTt. The valve timing control is performed by calculating a drive duty DU based on the engine operation state and adjusting applied voltage to the electromagnetic solenoid 55 of the OCV 50 based on the calculated drive duty DU. The drive duty DU is calculated, for example, using equation (1) described below.

$$\text{drive duty } DU = \text{proportion correction member } P + \text{derivative correction member } D + \text{hold duty } H \quad (1)$$

In equation (1), the proportion correction member P is a feedback correction value that is set in accordance with the deviation of the actual valve timing VT from the target valve timing VTt. The derivative correction member D is a feedback correction valve that is set in accordance with a change speed of the deviation of the actual valve timing VT from the target valve timing VTt. More specifically, when the actual valve timing VT is located at the advance side of the target valve timing VTt, the drive duty DU is increased by an addition value of the proportion correction member P and the derivative correction member D. When the drive duty DU of the OCV 50 is increased, the actual valve timing VT retards and approaches the target valve timing VTt. When the actual valve timing VT is located at the retardation side of the target valve timing VTt, the drive duty DU is decreased by an addition value of the proportion correction member P and the derivative correction member D. When the drive duty DU of the OCV 50 is decreased, the actual valve timing VT advances and approaches the target valve timing VTt.

In equation (1), the hold duty H is a value of the drive duty DU that is needed to hold the constant actual valve timing VT of the intake valve 21. It is apparent from equation (1) that the hold duty H serves as a median value when the drive duty DU increases and decreases in accordance with increases and decreases of the proportion correction member P and the derivative correction member D. The value of the hold duty H changes, for example, depending on the temperature of the hydraulic oil, and thus is learned in correspondence with the operation state. When the actual valve timing VT is held at the constant timing during feedback control of the actual valve timing VT, the hold duty H is learned by storing the present drive duty DU in a memory of the control device 31 as the newest hold duty H.

Additionally, the value of the hold duty H changes depending on whether the actual valve timing VT of the intake valve 21 is in the spring region or the non-spring region in addition to the temperature of the hydraulic oil, which has been described. Thus, the hold duty H is learned in each of the spring region and the non-spring region. In the valve timing control, when the actual valve timing VT of the intake valve 21 is in the spring region, the hold duty H that is learned in the spring region is used to calculate the drive duty DU. When the actual valve timing VT of the intake valve 21 is in the non-spring region, the hold duty H that is learned in the non-spring region is used to calculate the drive duty DU. Thus, the hold duty H functions as a control amount (holding control amount) of the OCV 50 that is needed to hold the constant actual valve timing VT, and the value of the hold duty H is independently learned when the actual valve timing VT is in the spring region and the non-spring region.

When the control device 31 performs a hold duty setting process, the hold duty H is set to the newest value. The procedures for performing the hold duty setting process will now be described with reference to FIG. 5. The control device 31 is configured to perform the hold duty setting process of FIG. 5. The hold duty setting process is repetitively performed in predetermined cycles while the engine operates.

Figure 5:
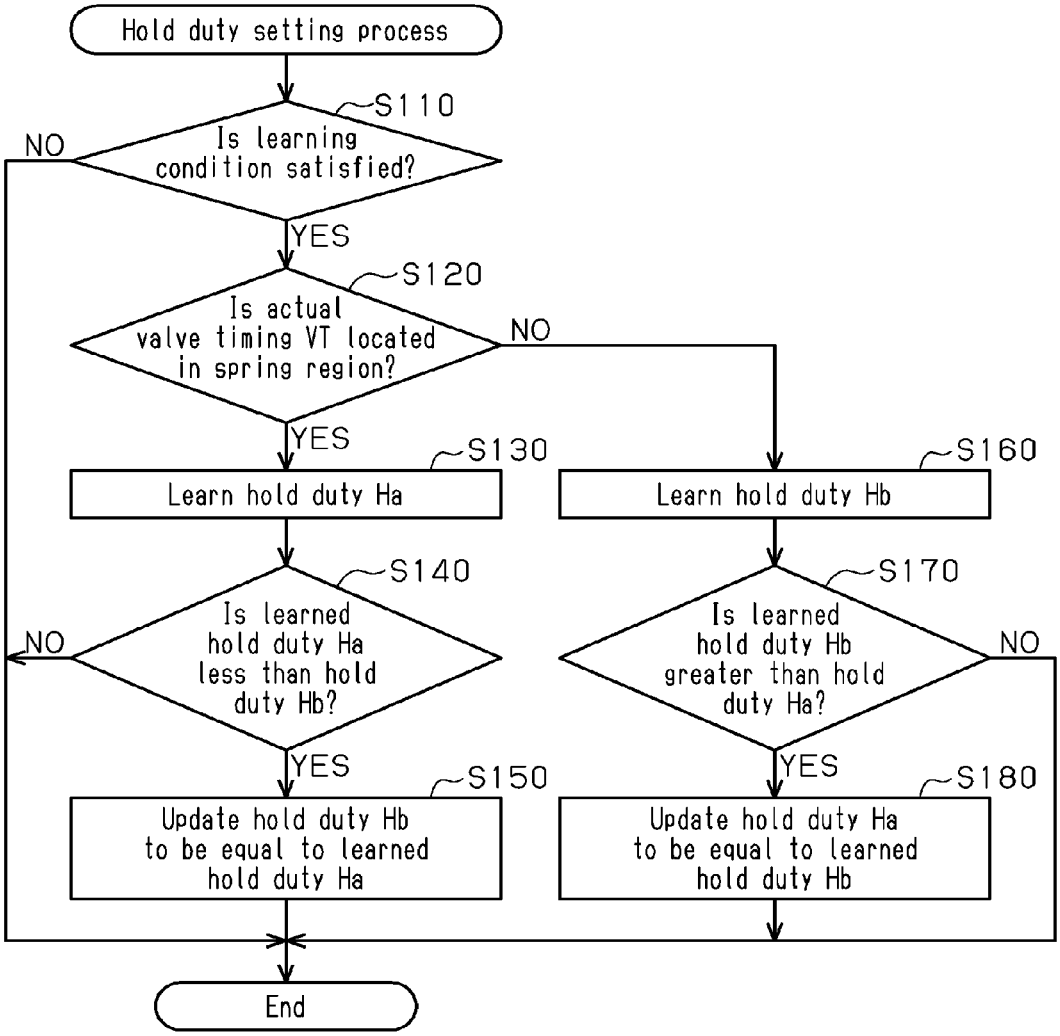
FIG. 5 is a flowchart showing the procedures for performing a hold duty setting process.

As shown in FIG. 5, when the hold duty setting process starts, it is determined whether or not a learning condition is satisfied (step S110). The learning condition is satisfied when the change amount of the actual valve timing VT continues to be less than a predetermined value for a predetermined time during feedback control of the actual valve timing VT to the target valve timing VTt. When it is determined that the learning condition is not satisfied (step S110: NO), the present process is temporarily terminated.

When it is determined that the learning condition is satisfied (step S110: YES), it is determined whether or not the actual valve timing VT is in the spring region (step S120).

When it is determined that the actual valve timing VT is in the spring region (step S120: YES), the hold duty H of the spring region (hold duty Ha) is learned (step S130). This learning is performed by setting the present drive duty DU as the newest hold duty Ha. When the hold duty Ha is learned, it is determined whether or not the learned hold duty Ha is less than the hold duty H of the non-spring region (hold duty Hb) (step S140). The hold duty Hb that is presently stored in the memory of the control device 31 is used as the comparison subject in step S140. When it is determined that the learned hold duty Ha is not less than the hold duty Hb (step S140: NO), the present process is temporarily terminated.

When it is determined that the learned hold duty Ha is less than the hold duty Hb (step S140: YES), the hold duty Hb is updated to be equal to the learned hold duty Ha (step S150). Through the process of step S150, the hold duty Ha and the hold duty Hb are stored as the same value in the memory of the control device 31. Subsequent to the update of the hold duty Hb, the present process is temporarily terminated.

When it is determined that the actual valve timing VT is in the non-spring region (step S120: NO), the hold duty H of the non-spring region (hold duty Hb) is learned (step S160). This learning is performed by setting the present drive duty DU as the newest hold duty Hb. When the hold duty Hb is learned, it is determined whether or not the learned hold duty Hb is greater than the hold duty Ha (step S170). The hold duty Ha that is presently stored in the memory of the control device 31 is used as the comparison subject in step S170. When it is determined that the learned hold duty Hb is not greater than the hold duty Ha (step S170: NO), the present process is temporarily terminated.

When it is determined that the learned hold duty Hb is greater than the hold duty Ha (step S170: YES), the hold duty Ha is updated to be equal to the learned hold duty Hb (step S180). Through the process of step S180, the hold duty Hb and the hold duty Ha are stored as the same value in the memory of the control device 31. Subsequent to the update of the hold duty Ha, the present process is temporarily terminated.

In the hold duty setting process, step S110, step S120, step S130, and step S160 correspond to a learning process, and step S140, step S150, step S170, and step S180 correspond to an update process.

The operation of the control device 31 will now be described.

Depending on the engine operation state, the hold duty H may be continuously learned in a first region, which is one of the spring region and the non-spring region, during which the hold duty H is not learned in a second region, which is the other one of the spring region and the non-spring region. In this case, the hold duty H of the first region, in which the learning is performed, is sequentially changed to a value corresponding to the present operation state of the variable valve timing mechanism 40 such as viscosity of the hydraulic oil. However, the hold duty H of the second region, in which the learning is not performed, is not learned. Under this situation, if the above update process is not performed, the magnitude relationship in the hold duty H between the spring region and the non-spring region would be inverted from the original relationship, in which the hold duty H of the spring region is greater than the hold duty H of the non-spring region.

A case in which the update process is not performed under a situation in which the hold duty Ha of the spring region is continuously learned while the hold duty Hb of the non-spring region is not learned will now be described with reference to FIG. 6.

As shown in FIG. 6, when the target valve timing VTt is changed from a region located at the retardation side of the intermediate phase to a region located at the advance side of the intermediate phase in accordance with the engine operation state, the actual valve timing VT is deviated from the target valve timing VTt (timing t1). In the case shown in FIG. 6, the actual valve timing VT is set at the retardation side of the target valve timing VTt. Thus, the drive duty DU of the OCV 50 is less than the hold duty Ha by the addition value of the proportion correction member P and the derivative correction member D. Here, the actual valve timing VT is in the spring region. Thus, the hold duty Ha of the spring region is used to calculate the drive duty DU.

During the feedback control using the drive duty DU of the OCV 50, when the change amount of the actual valve timing VT continues to be less than a determination value for the predetermined time, the learning condition is determined being satisfied. Thus, the present drive duty DU is learned as the newest hold duty Ha (timing t2). In the case shown in FIG. 6, the hold duty Ha subsequent to the learning becomes smaller than the hold duty Hb (indicated by single-dashed line in FIG. 6), which is presently stored in the memory of the control device 31. Then, the drive duty DU of the OCV 50 is decreased from the hold duty Ha by the addition value of the proportion correction member P and the derivative correction member D.

When the hold duty Ha is learned again (timing t3), the drive duty DU of the OCV 50 becomes further less. Thus, the actual valve timing VT advances and approaches the target valve timing VTt (timing t3 to t4).

When the actual valve timing VT is shifted to the non-spring region, the hold duty Hb of the non-spring region is used to calculate the drive duty DU (timing t4). Here, the value of the hold duty Hb is greater than that of the most recent hold duty Ha (hold duty Ha in timing t3 to t4). Thus, the value of the drive duty DU of the OCV 50, which is set based on the hold duty Hb, becomes larger than that of the hold duty Ha. This retards the actual valve timing VT beyond the intermediate phase (timing t5). Thus, the actual valve timing VT is shifted to the spring-region again.

When the actual valve timing VT is shifted to the spring-region, the hold duty Ha is used to calculate the drive duty DU. Thus, the drive duty DU of the OCV 50 is decreased, and the actual valve timing VT advances again. Then, when the actual valve timing VT is shifted to the non-spring region (timing t6), the hold duty Hb is used to calculate the drive duty DU. This increases the drive duty DU of the OCV 50 and retards the actual valve timing VT again (timing t7). Subsequently, the advancing of the actual valve timing VT to the non-spring region (timing t8) and the retarding of the actual valve timing to the spring region (timing t9) are repeated. In this manner, when hunting occurs in the actual valve timing VT, the actual valve timing VT fails to follow changes in the target valve timing VTt.

As shown in FIG. 7, in the present embodiment, which performs the above update process, when the learning condition is satisfied, the hold duty Ha is learned (timing t12) in the same manner as timing t2 of FIG. 6. In this case, the learned hold duty Ha becomes smaller than the hold duty Hb (indicated by single-dashed line in FIG. 7). Thus, the hold duty Hb is updated to be equal to the learned hold duty Ha. Subsequently, when the hold duty Ha is learned again, the hold duty Hb is updated to be equal to the learned hold duty Ha (timing t13). More specifically, whenever the learned hold duty Ha becomes smaller than the present hold duty Hb, the hold duty Hb is updated.

When the actual valve timing VT is shifted to the region located at the advance side of the intermediate phase, the hold duty Hb, which is the hold duty H of the non-spring region, is used to calculate the drive duty DU (timing t14). Here, the value of the hold duty Hb is equal to that of the most recent hold duty Ha (hold duty Ha in timing t13 to t14). Thus, retardation of the actual valve timing VT is restricted even when the drive duty DU is calculated using the hold duty Hb.

Subsequently, when the learning condition is satisfied again and the hold duty Hb is learned (timing t15), the original relationship is obtained so that the hold duty Ha is greater than the hold duty Hb. Thus, the actual valve timing VT may approach the target valve timing VTt.

Additionally, in timing t12 or timing t13, when the learning condition is satisfied and the hold duty Ha is learned, if the learned hold duty Ha is greater than or equal to the hold duty Hb, the hold duty Hb is not updated. Even in this case, the original relationship, in which the hold duty Ha is greater than the hold duty Hb, is not inverted.

FIGS. 6 and 7 each illustrate a case in which the hold duty Ha is continuously learned while the hold duty Hb is not learned. However, hunting would also occur in the actual valve timing VT when the hold duty Hb is continuously learned while the hold duty Ha is not learned. In this regard, in the above update process, whenever a condition in which the learned hold duty Hb becomes larger than the hold duty Ha is satisfied, the hold duty Ha may be updated to be equal to the learned hold duty Hb. Thus, even when the hold duty Hb is continuously learned, the actual valve timing VT approaches the target valve timing VTt.

The above control device 31 has the advantages described below.

(1) Even if one of the hold duties H, namely, the hold duty Ha and the hold duty Hb, is continuously learned but the other hold duty H is not learned, when the relative rotation phase is changed in the region where the learning is not performed, the relationship is satisfied so that the hold duty Ha of the spring region is greater than or equal to the hold duty Hb of the non-spring region. This prevents the inversion of the magnitude relationship between the hold duty Ha of the spring region and the hold duty Hb of the non-spring region from the original relationship, that is, the magnitude relationship in the drive duty DU of the OCV 50 that is needed to hold the actual valve timing VT at the constant timing in each region. Thus, even when one of the hold duties H, the hold duty Ha or the hold duty Hb, is not learned while the other hold duty H is continuously learned, hunting of the actual valve timing VT is limited when the target valve timing VTt is shifted across regions.

(2) The learning process of one of the hold duties H, the hold duty Ha or the hold duty Hb, is performed together with the update process of the other hold duty H. The update process would be performed by decreasing or increasing the hold duty H by a predetermined amount. However, when performing such an update process, the predetermined amount needs to be set in advance through experiments or to an appropriate value in each update process. In the above control device 31, the update process is performed without using such a predetermined value. This simplifies the update process.

The above embodiment may be modified as follows.

In the update process, the hold duty H of the first region, where the learning is performed, may be increased or decreased by a predetermined amount, and the increased or decreased value may be used as an update value of the hold duty H of the second region. More specifically, in step S150 of FIG. 5, a value that is less than the learned hold duty Ha by the predetermined amount may be used as the update value of the hold duty Hb. Also, in step S180, a value that is greater than the learned hold duty Hb by the predetermined amount may be used as the update value of the hold duty Ha.

Depending on the structure of the variable valve timing mechanism 40 and the OCV 50, the relationship may be such that the hold duty Hb of the non-spring region is greater than the hold duty Ha of the spring region. In such a case, the update process may be performed as follows. That is, in step S140 of FIG. 5, the control device 31 determines whether or not the learned hold duty Ha is greater than the hold duty Hb. When the learned hold duty Ha is determined being greater than the hold duty Hb, in the step S150, the hold duty Hb is updated. Additionally, in step S170, the control device 31 determines whether or not the learned hold duty Hb is less than the hold duty Ha. When the learned hold duty Hb is determined being less than the hold duty Ha, in step S180, the hold duty Ha is updated. In this mode, when the hold duty H is continuously learned in one of the spring region and the non-spring region, the relationship is constantly satisfied so that the hold duty Hb, which is the hold duty H of the non-spring region, is greater than or equal to the hold duty Ha, which is the hold duty H of the spring region. This limits hunting of the actual valve timing VT when the target valve timing VTt is shifted between the spring region and the non-spring region.

Also, in the above modified example, the hold duty H of the first region, corresponding to the region where the learning is performed, may be increased or decreased by a predetermined amount, the increased or decreased value may be used as an update value of the hold duty H of the second region, corresponding to the other region. More specifically, in step S150 of FIG. 5, a value that is greater than the learned hold duty Ha by the predetermined amount may be used as the update value of the hold duty Hb. Also, in step S180, a value that is less than the learned hold duty Hb by the predetermined amount may be used as the update value of the hold duty Ha.

Steps S140, S150, S170, S180 may be omitted from the hold duty setting process of FIG. 5. In this case, the update process may be performed separately from the process of FIG. 5 when the relative rotation phase is shifted from the first region, corresponding to one of the spring region and the non-spring region, to the second region, corresponding to the other region. In this mode, the update process is performed, for example, as follows. That is, when the relative rotation phase is shifted from the spring region to the non-spring region, the control device 31 determines whether or not the hold duty Ha of the spring region that is presently stored in the memory of the control device 31, or the hold duty Ha that was last learned in the spring region, is less than the hold duty Hb of the non-spring region, which is stored in the memory of the control device 31. When determining that the hold duty Ha is less than the hold duty Hb, the control device 31 updates the hold duty Hb so that the hold duty Hb becomes equal to the hold duty Ha. When determining that the hold duty Ha is not less than the hold duty Hb, that is, greater than or equal to the hold duty Hb, the update process is not performed on the hold duty Hb. Additionally, when the relative rotation phase is shifted from the non-spring region to the spring region, the control device 31 determines whether or not the hold duty Hb of the non-spring region that is presently stored in the memory of the control device 31, or the hold duty Hb that was last learned in the non-spring region, is greater than the hold duty Ha of the spring region, which is stored in the memory of the control device 31. When determining that the hold duty Hb is greater than the hold duty Ha, the control device 31 updates the hold duty Ha so that the hold duty Ha becomes equal to the hold duty Hb. When determining that the hold duty Hb is not greater than the hold duty Ha, that is, less than or equal to the hold duty Ha, the update process is not performed on the hold duty Ha. Also, in this mode, when the hold duty H is continuously learned in one of the spring region and the non-spring region, the relationship is satisfied so that the hold duty Ha, which is the hold duty H of the spring region, is greater than or equal to the hold duty Hb, which is the hold duty H of the non-spring region. Thus, in the same manner as the above embodiment, hunting of the actual valve timing VT is limited when the target valve timing VTt is shifted between the spring region and the non-spring region.

In the update process of the above modified example, the hold duty H of the first region, corresponding to the region where the learning is performed, may be increased or decreased by a predetermined amount, and the increased or decreased value may be used as an update value of the hold duty H of the second region, corresponding to the other region. More specifically, a value that is less than the last learned hold duty Ha by the predetermined amount may be used as the update value of the hold duty Hb. Also, a value that is greater than the last learned hold duty Hb by the predetermined amount may be used as the update value of the hold duty Ha.

Depending on the structure of the variable valve timing mechanism 40 and the OCV 50, the relationship may be such that the hold duty Hb of the non-spring region is greater than the hold duty Ha of the spring region. In such a case, the update process of the above modified example may be performed as follows. That is, when the relative rotation phase is shifted from the spring region to the non-spring region, the control device 31 determines whether or not the last learned hold duty Ha is greater than the hold duty Hb. When the last learned hold duty Ha is determined being greater than the hold duty Hb, the control device 31 updates the hold duty Hb. Additionally, when the relative rotation phase is shifted from the non-spring region to the spring region, the control device 31 determines whether or not the last learned hold duty Hb is less than the hold duty Ha. When the last learned hold duty Hb is determined being less than the hold duty Ha, the control device 31 updates the hold duty Ha. In this mode, even when the hold duty H is continuously learned in one of the spring region and the non-spring region and the relative rotation phase is changed in the region where the learning is not performed, the relationship is satisfied so that the hold duty Hb, which is the hold duty H of the non-spring region, is greater than or equal to the hold duty Ha, which is the hold duty H of the spring region. Thus, in the same manner as the above embodiment, hunting of the actual valve timing VT is limited when the target valve timing VTt is shifted between the spring region and the non-spring region.

Also, in the above modified example, the hold duty H of the first region, corresponding to one of the regions where the last learning is performed, may be increased or decreased by a predetermined amount, and the increased or decreased value may be used as an update value of the hold duty H of the second region, corresponding to the other region. More specifically, a value that is greater than the last learned hold duty Ha by the predetermined amount may be used as the update value of the hold duty Hb. Also, a value that is less than the last learned hold duty Hb by the predetermined amount may be used as the update value of the hold duty Ha.

Steps S140, S150, S170, S180 may be omitted from the hold duty setting process of FIG. 5. In this case, a restriction process, which restricts the value of the hold duty H used to calculate the drive duty DU, may be performed separately from the process of FIG. 5.

In this mode, when the relative rotation phase is in the spring region, the process is performed, for example, as follows. That is, the control device 31 compares the hold duty Ha stored in the memory of the control device 31 with the hold duty Hb stored in the memory of the control device 31, or the hold duty Hb that was last learned in the non-spring region. Then, the control device 31 uses the larger one of the hold duty Ha and the hold duty Hb as the hold duty H of equation (1) to calculate the drive duty DU. Through the process, when the relative rotation phase is in the spring region, the control device 31 restricts the value of the hold duty Ha of the spring region, which is used to calculate the drive duty DU, so that the hold duty Hb that was last learned in the non-spring region is set as the lower limit value. Thus, when the relative rotation phase is in the spring region and the hold duty Hb is greater than the hold duty Ha, which is stored in the memory of the control device 31, the hold duty Hb is used to calculate the drive duty DU instead of the hold duty Ha.

When the hold duty Ha is greater than or equal to the hold duty Hb, which is stored in the memory of the control device 31, the hold duty Ha is used to calculate the drive duty DU. Thus, even when the hold duty Hb of the non-spring region is continuously learned while the hold duty Ha of the spring region is not learned and the relative rotation phase is changed in the spring region, where the learning is not performed, the relationship is satisfied so that the hold duty H, which is used to calculate the drive duty DU, is greater than or equal to the hold duty Hb of the non-spring region.

Additionally, in this mode, when the relative rotation phase is in the non-spring region, the process is performed, for example, as follows. That is, the control device 31 compares the hold duty Hb stored in the memory of the control device 31 with the hold duty Ha stored in the memory of the control device 31, or the hold duty Ha that was last learned in the spring region. Then, the control device 31 uses the smaller value of the hold duty Hb and the hold duty Ha as the hold duty H of equation (1) to calculate the drive duty DU. Through the process, when the relative rotation phase is in the non-spring region, the control device 31 restricts the value of the hold duty Hb of the non-spring region, which is used to calculate the drive duty DU, so that the hold duty Ha that was last learned in the spring region is set as the upper limit value. Thus, when the relative rotation phase is in the non-spring region and the hold duty Ha is less than the hold duty Hb, which is stored in the memory of the control device 31, the hold duty Ha is used to calculate the drive duty DU instead of the hold duty Hb.

When the hold duty Hb is less than or equal to the hold duty Ha, which is stored in the memory of the control device 31, the hold duty Hb is used to calculate the drive duty DU. Thus, even when the hold duty Ha of the spring region is continuously learned while the hold duty Hb of the non-spring region is not learned and the relative rotation phase is changed in the non-spring region, where the learning is not performed, the relationship is satisfied so that the hold duty H, which is used to calculate the drive duty DU, is less than or equal to the hold duty Ha of the spring region.

Depending on the structure of the variable valve timing mechanism 40 and the OCV 50, the relationship may be such that the hold duty H of the non-spring region (hold duty Hb) is greater than the hold duty H of the spring region (hold duty Ha).

In such a case, the restriction process of the above modified example may be performed as follows. That is, when the relative rotation phase is in the spring region, the control device 31 uses the smaller value of the hold duty Hb and the hold duty Ha, which are stored in the memory of the control device 31, as the hold duty H of equation (1) to calculate the drive duty DU. Through the process, when the relative rotation phase is in the spring region, the control device 31 restricts the value of the hold duty Ha of the spring region, which is used to calculate the drive duty DU, so that the hold duty Hb that was last learned in the non-spring region is set as the upper limit value.

When the relative rotation phase is in the non-spring region, the control device 31 uses the larger one of the hold duty Hb and the hold duty Ha, which are stored in the memory of the control device 31, as the hold duty H of equation (1) to calculate the drive duty DU. Through the process, when the relative rotation phase is in the non-spring region, the control device 31 restricts the value of the hold duty Hb of the non-spring region, which is used to calculate the drive duty DU, so that the hold duty Ha that was last learned in the spring region is set as the lower limit value. In this mode, even when the hold duty H is continuously learned on one of the spring region and the non-spring region and the relative rotation phase is changed in the region where the learning is not performed, the relationship is satisfied so that the hold duty Hb, which is the hold duty H of the non-spring region, is greater than or equal to the hold duty Ha, which is the hold duty H of the spring region. Thus, hunting of the actual valve timing VT is limited when the target valve timing VTt is shifted between the spring region and the non-spring region.

In each of the above embodiment and modified examples, the update process and the restriction process are performed when the relative rotation phase is in each of the spring region and the non-spring region. Instead, the update process and the restriction process may be performed in only one of the regions.

The lock mechanism 47 may be omitted. In this mode, the release chamber 48 and the release oil channel 67 are also omitted. Additionally, the lock mode is omitted from the operation mode of the OCV 50. Further, in each mode, the supply and discharge of the hydraulic oil to and from the release chamber 48 are omitted. Even in this mode, the urging force of the spring 49 may be used to advance the actual valve timing VT to the predetermined phase during startup of the engine.

The supply and discharge of the hydraulic oil to and from the advancing chambers 45 and the retarding chambers 46 are controlled based on the drive duty DU of the electromagnetic solenoid 55. However, instead of the drive duty DU, the supply and discharge of the hydraulic oil may be controlled by changing an applied voltage to the electromagnetic solenoid 55.

The illustrated variable valve timing mechanism 40 includes the spring 49 that urges the rotor 41 to the advance side. However, even when the variable valve timing mechanism 40 includes the spring 49 that urges the rotor 41 to the retardation side, the same advantages may be obtained.

The above hunting limiting control may be applied to a variable valve timing mechanism including a housing that rotates synchronously with the crankshaft 17, a rotor that rotates together with the exhaust camshaft 25, and a spring that urges the rotor so that the relative rotation phase of the housing and the rotor is in a position corresponding to the intermediate phase between the most retarded phase and the most advanced phase. In this mode, the spring, which urges the rotor, may urge the rotor to the advance side or the retardation side.

The invention claimed is:

1. A control device for an internal combustion engine, the control device comprising:

a variable valve timing mechanism, wherein the variable valve timing mechanism includes a first rotation body, which rotates in cooperation with rotation of a crankshaft, and a second rotation body, which rotates together with a camshaft;

the variable valve timing mechanism varies a valve timing of an engine valve by changing a relative rotation phase of the second rotation body and the first rotation body using hydraulic pressure, which is supplied from a hydraulic control valve to an advancing chamber and a retarding chamber;

the variable valve timing mechanism includes a spring that urges the second rotation body so that the relative rotation phase is located at a position corresponding to a predetermined phase between a most advanced phase and a most retarded phase;

when a region of the relative rotation phase where the second rotation body receives urging force from the spring defines a spring region and a region of the relative rotation phase where the second rotation body does not receive urging force from the spring defines a non-spring region, a control amount of the hydraulic control valve needed to hold an actual valve timing at a constant timing in the spring region is greater than a control amount of the hydraulic control valve needed to hold the actual valve timing at a constant timing in the non-spring region;

the control device for the internal combustion engine is configured to perform a learning process that learns a holding control amount of the hydraulic control valve when the actual valve timing is held at a constant timing in each of the spring region and the non-spring region; and the control device for the internal combustion engine is configured to perform at least one of an update process that updates the holding control amount of the non-spring region whenever the holding control amount of the spring region, which is learned in the learning process, becomes less than the holding control amount of the non-spring region to satisfy a relationship in which the holding control amount of the non-spring region is less than or equal to the holding control amount of the spring region, and an update process that updates the holding control amount of the spring region whenever the holding control amount of the non-spring region, which is learned in the learning process, becomes greater than the holding control amount of the spring region to satisfy a relationship in which the holding control amount of the spring region is greater than or equal to the holding control amount of the non-spring region.

2. The control device according to claim 1, wherein one of the spring region and the non-spring region in which the holding control amount is learned in the learning process defines a first region, the other one of the spring region and the non-spring region defines a second region, and the control device for the internal combustion engine is configured to update the holding control amount of the second region so that the holding control amount of the second region becomes equal to the holding control amount of the first region.

3. The control device according to claim 1, wherein the variable valve timing mechanism includes a lock mechanism that fixes the relative rotation phase at an intermediate phase.

4. A control device for an internal combustion engine, the control device comprising:

a variable valve timing mechanism, wherein the variable valve timing mechanism includes a first rotation body, which rotates in cooperation with rotation of a crankshaft, and a second rotation body, which rotates together with a camshaft;

the variable valve timing mechanism varies a valve timing of an engine valve by changing a relative rotation phase of the second rotation body and the first rotation body using hydraulic pressure, which is supplied from a hydraulic control valve to an advancing chamber and a retarding chamber;

the variable valve timing mechanism includes a spring that urges the second rotation body so that the relative rotation phase is located at a position corresponding to a predetermined phase between a most advanced phase and a most retarded phase;

when a region of the relative rotation phase where the second rotation body receives urging force from the spring defines a spring region and a region of the relative rotation phase where the second rotation body does not receive urging force from the spring defines a non-spring region, a control amount of the hydraulic control valve needed to hold an actual valve timing at a constant timing in the spring region is greater than a control amount of the hydraulic control valve needed to hold the actual valve timing at a constant timing in the non-spring region;

the control device for the internal combustion engine is configured to perform a learning process that learns a holding control amount of the hydraulic control valve when the actual valve timing is held at a constant timing in each of the spring region and the non-spring region; and the control device for the internal combustion engine is configured to perform at least one of an update process that updates the holding control amount of the non-spring region when the relative rotation phase is shifted from the spring region to the non-spring region so that the holding control amount of the non-spring region satisfies a relationship in which the holding control amount of the non-spring region is less than or equal to the holding control amount that was last learned in the spring region, and an update process that updates the holding control amount of the spring region when the relative rotation phase is shifted from the non-spring region to the spring region so that the holding control amount of the spring region satisfies a relationship in which the holding control amount of the spring region is greater than or equal to the holding control amount that was last learned in the non-spring region.

5. The control device according to claim 4, wherein one of the spring region and the non-spring region in which the holding control amount is learned in the learning process defines a first region, the other one of the spring region and the non-spring region defines a second region, and the control device for the internal combustion engine is configured to update the holding control amount of the second region so that the holding control amount of the second region becomes equal to the holding control amount of the first region.

6. The control device according to claim 4, wherein the variable valve timing mechanism includes a lock mechanism that fixes the relative rotation phase at an intermediate phase.

7. A control device for an internal combustion engine, the control device comprising:

a variable valve timing mechanism, wherein the variable valve timing mechanism includes a first rotation body, which rotates in cooperation with rotation of a crankshaft, and a second rotation body, which rotates together with a camshaft;

the variable valve timing mechanism varies a valve timing of an engine valve by changing a relative rotation phase of the second rotation body and the first rotation body using hydraulic pressure, which is supplied from a hydraulic control valve to an advancing chamber and a retarding chamber;

the variable valve timing mechanism includes a spring that urges the second rotation body so that the relative rotation phase is located at a position corresponding to a predetermined phase between a most advanced phase and a most retarded phase;

when a region of the relative rotation phase where the second rotation body receives urging force from the spring defines a spring region and a region of the relative rotation phase where the second rotation body does not receive urging force from the spring defines a non-spring region, a control amount of the hydraulic control valve needed to hold an actual valve timing at a constant timing in the spring region is greater than a control amount of the hydraulic control valve needed to hold the actual valve timing at a constant timing in the non-spring region;

the control device for the internal combustion engine is configured to perform a learning process that learns a holding control amount of the hydraulic control valve when the actual valve timing is held at a constant timing in each of the spring region and the non-spring region; and the control device for the internal combustion engine is configured to perform at least one of a restriction process that restricts a lower limit value of the holding control amount of the spring region when the relative rotation phase is in the spring region to the holding control amount that was last learned in the non-spring region, and a restriction process that restricts an upper limit value of the holding control amount of the holding control amount of the non-spring region when the relative rotation phase is in the non-spring region to the holding control amount that was last learned in the spring region.

8. The control device according to claim 7, wherein the variable valve timing mechanism includes a lock mechanism that fixes the relative rotation phase at an intermediate phase.

9. A control device for an internal combustion engine, the control device comprising:

a variable valve timing mechanism, wherein the variable valve timing mechanism includes a first rotation body, which rotates in cooperation with rotation of a crankshaft, and a second rotation body, which rotates together with a camshaft;

the variable valve timing mechanism varies a valve timing of an engine valve by changing a relative rotation phase of the second rotation body and the first rotation body using hydraulic pressure, which is supplied from a hydraulic control valve to an advancing chamber and a retarding chamber;

the variable valve timing mechanism includes a spring that urges the second rotation body so that the relative rotation phase is located at a position corresponding to a predetermined phase between a most advanced phase and a most retarded phase;

when a region of the relative rotation phase where the second rotation body receives urging force from the spring defines a spring region and a region of the relative rotation phase where the second rotation body does not receive urging force from the spring defines a non-spring region, a control amount of the hydraulic control valve needed to hold an actual valve timing at a constant timing in the non-spring region is greater than a control amount of the hydraulic control valve needed to hold the actual valve timing at a constant timing in the spring region;

the control device for the internal combustion engine is configured to perform a learning process that learns a holding control amount of the hydraulic control valve when the actual valve timing is held at a constant timing in each of the spring region and the non-spring region; and the control device for the internal combustion engine is configured to perform at least one of an update process that updates the holding control amount of the non-spring region whenever the holding control amount of the spring region, which is learned in the learning process, becomes greater than the holding control amount of the non-spring region to satisfy a relationship in which the holding control amount of the non-spring region is greater than or equal to the holding control amount of the spring region, and an update process that updates the holding control amount of the spring region whenever the holding control amount of the non-spring region, which is learned in the learning process, becomes less than the holding control amount of the spring region to satisfy a relationship in which the holding control amount of the spring region is less than or equal to the holding control amount of the non-spring region.

10. The control device according to claim 9, wherein one of the spring region and the non-spring region in which the holding control amount is learned in the learning process defines a first region, the other one of the spring region and the non-spring region defines a second region, and the control device for the internal combustion engine is configured to update the holding control amount of the second region so that the holding control amount of the second region becomes equal to the holding control amount of the first region.

11. The control device according to claim 9, wherein the variable valve timing mechanism includes a lock mechanism that fixes the relative rotation phase at an intermediate phase.

12. A control device for an internal combustion engine, the control device comprising:

a variable valve timing mechanism, wherein the variable valve timing mechanism includes a first rotation body, which rotates in cooperation with rotation of a crankshaft, and a second rotation body, which rotates together with a camshaft;

the variable valve timing mechanism varies a valve timing of an engine valve by changing a relative rotation phase of the second rotation body and the first rotation body using hydraulic pressure, which is supplied from a hydraulic control valve to an advancing chamber and a retarding chamber;

the variable valve timing mechanism includes a spring that urges the second rotation body so that the relative rotation phase is located at a position corresponding to a predetermined phase between a most advanced phase and a most retarded phase;

when a region of the relative rotation phase where the second rotation body receives urging force from the spring defines a spring region and a region of the relative rotation phase where the second rotation body does not receive urging force from the spring defines a non-spring region, a control amount of the hydraulic control valve needed to hold an actual valve timing at a constant timing in the non-spring region is greater than a control amount of the hydraulic control valve needed to hold the actual valve timing at a constant timing in the spring region;

the control device for the internal combustion engine is configured to perform a learning process that learns a holding control amount of the hydraulic control valve when the actual valve timing is held at a constant timing in each of the spring region and the non-spring region; and the control device for the internal combustion engine is configured to perform at least one of an update process that updates the holding control amount of the non-spring region when the relative rotation phase is shifted from the spring region to the non-spring region so that the holding control amount of the non-spring region satisfies a relationship in which the holding control amount of the non-spring region is greater than or equal to the holding control amount that was last learned in the spring region, and an update process that updates the holding control amount of the spring region when the relative rotation phase is shifted from the non-spring region to the spring region so that the holding control amount of the spring region satisfies a relationship in which the holding control amount of the spring region is less than or equal to the holding control amount that was last learned in the non-spring region.

13. The control device according to claim 12, wherein one of the spring region and the non-spring region in which the holding control amount is learned in the learning process defines a first region, the other one of the spring region and the non-spring region defines a second region, and the control device for the internal combustion engine is configured to update the holding control amount of the second region so that the holding control amount of the second region becomes equal to the holding control amount of the first region.

14. The control device according to claim 12, wherein the variable valve timing mechanism includes a lock mechanism that fixes the relative rotation phase at an intermediate phase.

15. A control device for an internal combustion engine, the control device comprising:

a variable valve timing mechanism, wherein the variable valve timing mechanism includes a first rotation body, which rotates in cooperation with rotation of a crankshaft, and a second rotation body, which rotates together with a camshaft;

the variable valve timing mechanism varies a valve timing of an engine valve by changing a relative rotation phase of the second rotation body and the first rotation body using hydraulic pressure, which is supplied from a hydraulic control valve to an advancing chamber and a retarding chamber;

the variable valve timing mechanism includes a spring that urges the second rotation body so that the relative rotation phase is located at a position corresponding to a predetermined phase between a most advanced phase and a most retarded phase;

when a region of the relative rotation phase where the second rotation body receives urging force from the spring defines a spring region and a region of the relative rotation phase where the second rotation body does not receive urging force from the spring defines a non-spring region, a control amount of the hydraulic control valve needed to hold an actual valve timing at a constant timing in the non-spring region is greater than a control amount of the hydraulic control valve needed to hold the actual valve timing at a constant timing in the spring region;

the control device for the internal combustion engine is configured to perform a learning process that learns a holding control amount of the hydraulic control valve when the actual valve timing is held at a constant timing in each of the spring region and the non-spring region; and the control device for the internal combustion engine is configured to perform at least one of a restriction process that restricts a lower limit value of the holding control amount of the non-spring region when the relative rotation phase is in the non-spring region to the holding control amount that was last learned in the spring region, and a restriction process that restricts an upper limit value of the holding control amount of the holding control amount of the spring region when the relative rotation phase is in the spring region to the holding control amount that was last learned in the non-spring region.

16. The control device according to claim 15, wherein the variable valve timing mechanism includes a lock mechanism that fixes the relative rotation phase at an intermediate phase.

* * * * *